US007247030B2

(12) United States Patent
Hilty et al.

(10) Patent No.: US 7,247,030 B2
(45) Date of Patent: Jul. 24, 2007

(54) BONDED THREE DIMENSIONAL LAMINATE STRUCTURE

(75) Inventors: Robert Daniel Hilty, Harrisburg, PA (US); Marjorie Kay Myers, Mount Wolf, PA (US); Michael Fredrick Laub, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/818,038

(22) Filed: Apr. 5, 2004

(65) Prior Publication Data

US 2005/0221634 A1 Oct. 6, 2005

(51) Int. Cl.
*H01R 12/00* (2006.01)

(52) U.S. Cl. ..... 439/71; 439/608

(58) Field of Classification Search ..... 439/70, 439/69, 483, 71–72, 700, 608
See application file for complete search history.

(56) References Cited

U.S. PATENT DOCUMENTS 3,312,583 A * 4/1967 Rochlis ..... 428/88
3,813,773 A * 6/1974 Parks ..... 29/830
4,359,181 A * 11/1982 Chisholm ..... 228/183
4,906,194 A * 3/1990 Grabbe ..... 439/71
4,957,800 A 9/1990 Grabbe
5,217,728 A 6/1993 Grabbe
5,596,266 A * 1/1997 Mori et al. ..... 324/71.1
5,844,310 A * 12/1998 Okikawa et al. ..... 257/712
5,858,145 A * 1/1999 Sreeram et al. ..... 156/89.16
6,032,362 A * 3/2000 Okikawa et al. ..... 29/890.03
6,200,153 B1 * 3/2001 Pei ..... 439/342
6,860,742 B2 * 3/2005 Shimada ..... 439/70
2003/0152488 A1 * 8/2003 Tonkovich et al. ..... 422/99
2004/0069638 A1 * 4/2004 Surh et al. ..... 204/600

* cited by examiner

*Primary Examiner*—J. F. Duverne

(57) ABSTRACT

A conductive structure and method of manufacturing therefor includes a plurality of stacked metal laminates secured to one another via an intermetallic bond made from a metallic bonding agent.

18 Claims, 4 Drawing Sheets

BONDED THREE DIMENSIONAL LAMINATE STRUCTURE

BACKGROUND OF THE INVENTION

This invention relates generally to three dimensional conductive structures and methods of making the same, and, more specifically, to the structure and manufacture of a metal laminated structure for a housing of an electrical connector.

Due to advances in processor technology, signal transmission rates between electronic devices and components is increasing. With increased signal transmission rates, the need for effective shielding of signal contacts in electrical connectors interconnecting the electrical components is of greater importance. In at least some connectors, such as, for example, ball grid array (BGA) sockets which connect a microprocessor to a printed circuit board, metallized housings are advantageous. The metallized housing shields the signal contacts and prevents cross-talk, as well as provides a larger ground path than is typically available in non-conductive connectors.

Conventionally, plastic housings have been manufactured via injection molding processes. These housings are subsequently metallized using a variety of techniques. Manufacturing the metallized housings, however, is problematic for increasingly miniaturized connectors. Thin walled constructions tend to be weak, and shrinkage or processing variations can frustrate dimensional specifications, flatness requirements, etc. Additionally, injection molded plastic tends to present mismatched thermal coefficients of expansion relative to the integrated circuit materials used and the thermal expansion properties of circuit boards with which they are used. The disparate thermal expansion properties of the metal and plastic creates thermal stress in the structure which may produce reliability issues. In particular, in a surface mount device, such as a BGA socket connector, the thermal stress may negatively impact the soldered connection to the circuit board.

To avoid limitations of injection molding processes for smaller structures, metal laminates are sometimes bonded together via a diffusion bonding process. Diffusion bonding, however, takes place in a vacuum and under controlled pressure conditions at regulated temperatures at or above approximately 80% of the metal homologous temperature for a sufficient time to form a sold state diffusion bond between the laminates. For most applications, diffusion bonding is an equipment intensive, time consuming, and prohibitively expensive process that is not feasible for high volume, low cost electronic components and connectors.

Another technique which may be used to form conductive structures is metallization of monolithic polymer materials. Achieving desired specifications (e.g., minimum wall thickness, cavity sizes, flatness and coplanarity requirements) for electrical connectors using such materials and methods, however, is exceedingly difficult.

Adhesive bonding may be used to join thin metal laminates to construct small structures. Adhesives, however, are typically not electrically conductive, and therefore impact the electrical properties of the structures. Conductive adhesives are expensive and may produce undesirable in the electrical properties of the housings.

It would be desirable to provide an economical structure for electrical connectors which avoids these and other issues.

BRIEF DESCRIPTION OF THE INVENTION

According to one exemplary embodiment, a conductive structure is provided which comprises a plurality of stacked metal laminates secured to one another via an intermetallic bond created from a metallic bonding agent.

Optionally the laminates may define a metal housing of an electrical connector, and the laminates may comprise an outer periphery and an array of apertures within the outer periphery. The intermetallic bond may be formed from a metallic bonding agent having a thickness of about 25 microns or less, and in one embodiment the intermetallic bond is formed from tin which is completely reacted with the laminates at a predetermined temperature for a predetermined time.

According to another exemplary embodiment, a housing for an electrical connector including a plurality of electrical contacts is provided. The housing comprises a plurality of laminates, and each of the plurality of laminates defines an outer periphery and a plurality of apertures. The laminates are substantially aligned with one another in a stacked arrangement, and the plurality of laminates are monolithically formed into a structure via an intermetallic bonding process with a metallic bonding agent which is completely reacted with the laminates. The apertures of the laminates define cavities configured to receive the electrical contacts.

In still another embodiment, a method for manufacturing a conductive structure is provided. The method comprises providing a plurality of metal laminates which are configured for stacking one upon another to define the structure, applying a metallic bonding agent to the laminates, stacking the laminates wherein the metallic bonding agent extends between adjacent laminations in the stack, and completely reacting or nearly completely reacting the bonding agent with the laminations to form an intermetallic bond zone between laminates which is devoid of a continuous layer of residual bonding agent material.

DETAILED DESCRIPTION OF THE INVENTION

Figure 1:
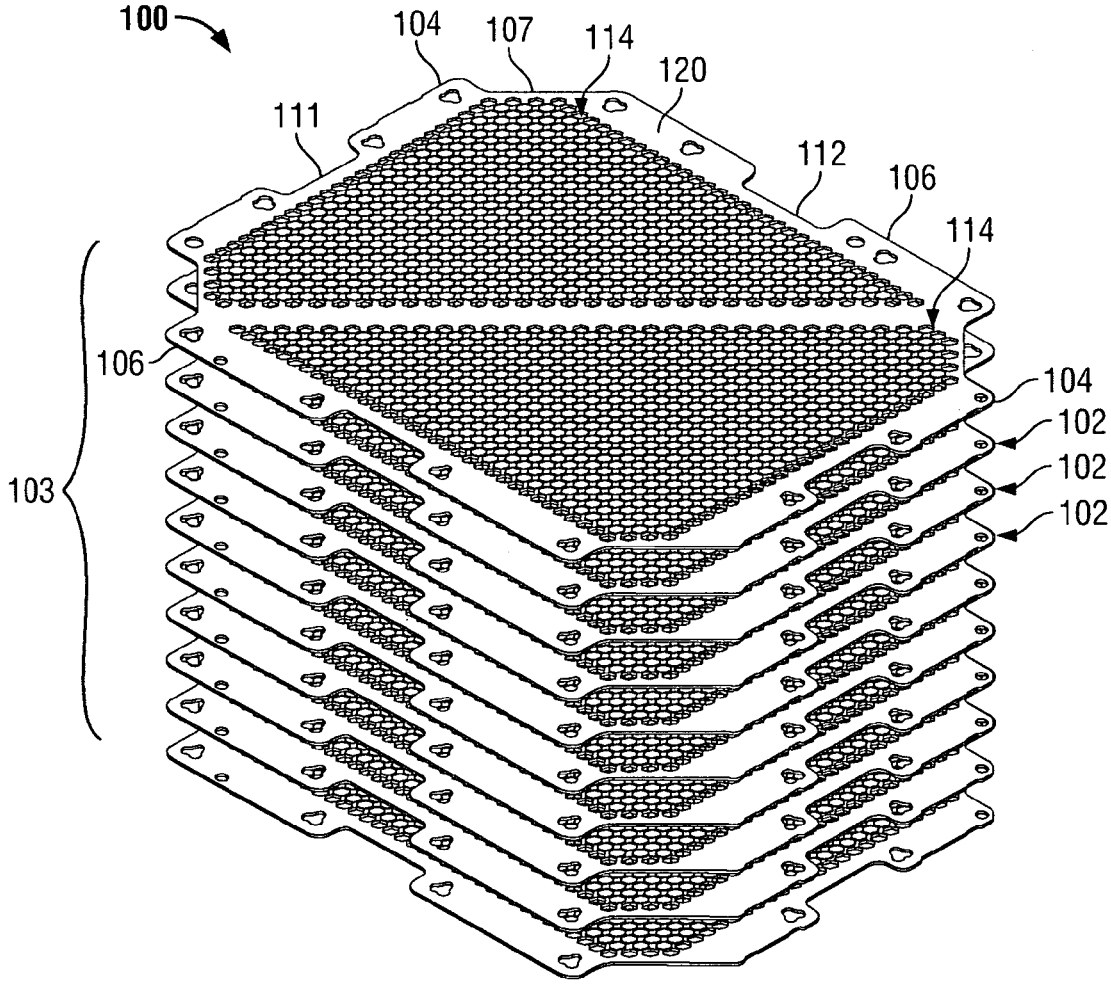
FIG. 1 is an exploded perspective view of a stacked metal laminate structure at a first stage of manufacture.
Figure 2:
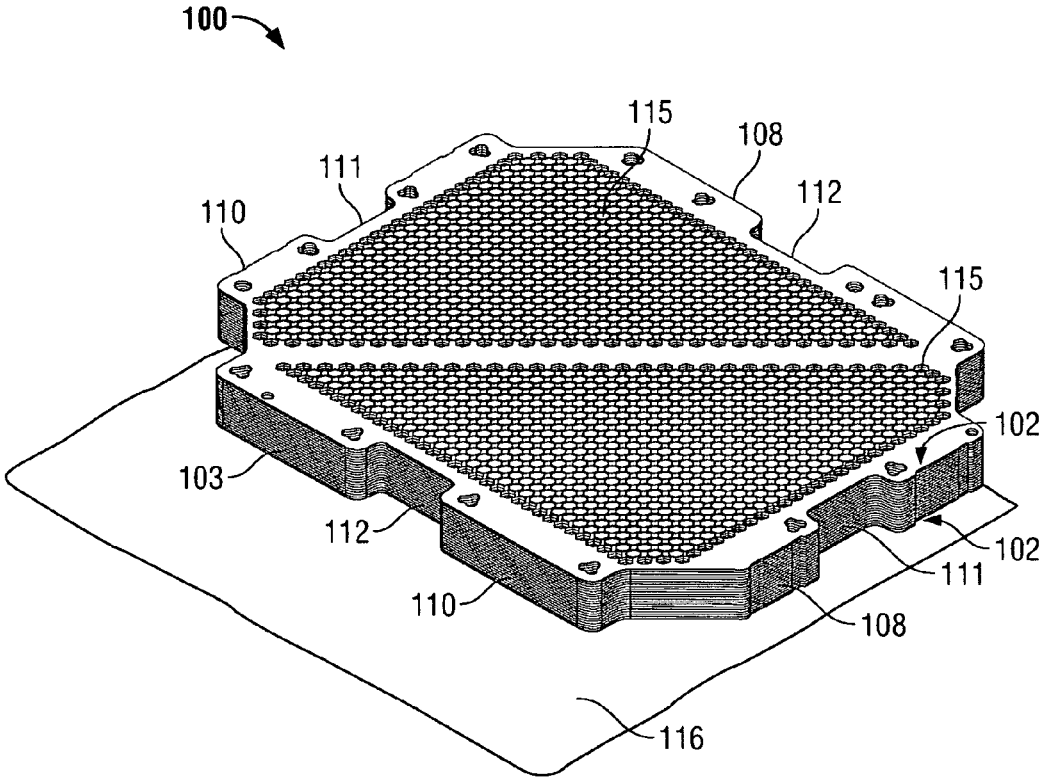
FIG. 2 is a perspective view of the structure shown in FIG. 1 at a second stage of manufacture.

FIGS. 1 and 2 are an exploded perspective view and an assembled view, respectively, of an exemplary stacked metal laminate structure 100. As will become evident below, the structure 100 is particularly advantageous for constructing a metal housing for an electrical connector, and more specifically to ball grid array (BGA) socket connector assembly which may be used to interface a ceramic microprocessor package with a circuit board. However, while the structure 100 is described in the context of a BGA socket connector, it is understood that the construction and methodology of the present invention as described hereinafter is not limited to housings for BGA socket assemblies, or even to electrical connectors for that matter. Rather, the illustrated embodiment is but one example of a conductive structure which may be formed in accordance with the inventive concepts herein.

In an exemplary embodiment, the structure 100 is fabricated from a plurality of separate or individual metal laminates 102 which are, in turn, fabricated from a conductive material or conductive alloy using a known process, such as die stamping or chemical etching. The laminates 102 are placed one upon another in a stack 103. While ten laminates 102 are illustrated in the stack 103 (shown in) in FIG. 1, it is appreciated that greater or fewer laminates 102 may be provided in further and/or alternative embodiments.

In an illustrative embodiment, the laminates 102 are formed having complementary outer peripheries defined by opposite side edges 104, opposite end edges 106, and angled corners 107 connecting the side edges 104 and 106. The laminates 102 are substantially planar and are arranged one upon another in a stack, thereby defining a substantially continuous surface 108 and 110 (shown in FIG. 2), respectively, in the stack 103. Perimeter indents 111 and 112 may be formed in the side edges 104 and 106, respectively to assist in alignment of the laminates 102 in the stack 103. Alternatively, the laminates 102 may include interior alignment features, (e.g., slots, points, or apertures) which are not on the periphery of the laminates but rather are located between the edges 104 and 106.

In an exemplary embodiment, the laminates 102 also include an array of contact apertures 114 which collectively define an array of contact cavities 115 (shown in FIG. 2) when the laminates 102 are stacked. In one embodiment, the cavities 115 receive electrical contacts (not shown) which, for example, electrically connect contact pins of a microprocessor package (not shown) to a circuit board 116 (FIG. 2) via a solder contact array, such as a ball grid array corresponding to the array of cavities 115. The laminates 102 in one embodiment are thus particularly suited for constructing a metal housing for a BGA socket connector. The laminates, and specifically the apertures 114, may be sized and configured to define contact cavities 115 which accept various contacts and/or contact assemblies, and selected laminates 102 may include different shapes, apertures or features from other of the laminates 102 to, for example, define stops or catch surfaces during engagement of contact pins of a processor package when inserted into the cavities 115. Additionally, laminates having differently sized and shaped outer peripheries from the laminates 102 may be provided in the stack 103 to define, for example, a base section having a first outer periphery and a socket section of the structure having a second outer periphery.

It should now be evident that with strategic formation, selection, and stacking of configuration of the laminates, including but not limited to the illustrated laminates 102, great flexibility in design is afforded to achieve specific objectives (e.g. minimum wall thickness, flatness requirements, etc.) that would be difficult, if not impossible, to achieve in a cost effective manner by conventional methods.

In one embodiment, the laminates 102 are fabricated from a base metal, such as copper, and the laminates 102 have a thickness of approximately 0.008 inches measured perpendicular to the planar surfaces 120 of the laminates 102. It is appreciated, however, that a greater or lesser thickness of the laminates 102 may be employed in alternative embodiments, and further it is contemplated that a thickness of the laminates 102 in the stack 103 need not be equal to one another. That is, one or more of the laminates 102 (e.g., the outermost laminates in the stack 103) may have a greater or lesser thickness than other of the laminates (e.g., the inner laminates) in the stack 103. Further, it is recognized that other materials familiar to those in the art may be used in lieu of copper to fabricate the laminates, including but not limited other base metals such as iron, steel, aluminum, tin, iron, nickel, cobalt, titanium, zinc. and the like. Alloys of copper, iron, steel, aluminum, tin, iron, nickel, cobalt, titanium, zinc and the like may also be employed to fabricate the laminates 102 as those in the art will appreciate.

Referring now to FIG. 2, the laminates 102 (shown in FIG. 1) in the stack 103 are bonded together with an intermetallic bond to form a monolithic structure 100. The intermetallic bonds are formed at lower temperatures and pressures and without vacuum conditions that diffusion bonding processes require and are thus simpler and less costly to manufacture the structure 100 than other known methods, such as diffusion bonding. Intermetallic bonding of the laminates 102 further realizes desired specifications (e.g., minimum wall thickness, cavity sizes, flatness and coplanarity requirements, and mechanical stability) on a small scale which other methods cannot reliably achieve. Advantageously, the electrical properties of the structure may be consistently and reliably controlled during manufacture as explained below, and thermal stress issues in the construction of the structure 100 may be avoided.

Figure 3:
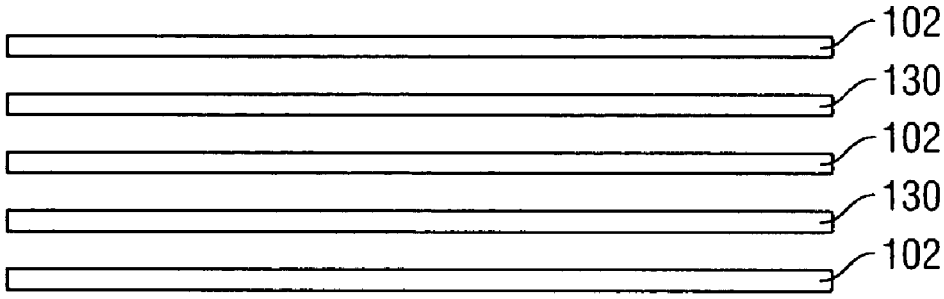
FIG. 3 is a partial schematic view of the structure shown in FIG. 1.

FIG. 3 is a partial schematic view of a portion of the structure 100 illustrating a metallic bonding agent 130 extending between the laminates 102. The bonding agent 130, as described below, forms an intermetallic bond between the laminates 102 which promotes dimensional stability to meet desired specifications of the structure 100, even for very small wall thickness, such as the area of the laminates 102 which defines the array of cavities 115 (shown in FIG. 2).

As illustrated in FIG. 3, a layer of bonding agent 130 is arranged between each pair of adjacent laminates 102 in the stack 103 (shown in FIGS. 1 and 2), with each layer of the bonding agent 130 sandwiched between adjacent laminates 102. That is, the laminates 102 and the bonding agent layers 130 are ordered in an alternating sequence in the stack 103.

In an exemplary embodiment, the layers of metallic bonding agent 130 are each a thin layer of metal, such as tin, which is plated, coated or otherwise applied to the facing surfaces of the laminates 102. Tin is particularly suited for the bonding agent 130 due to its natural reaction with other conductive metals, including but not limited to copper, under certain conditions. The natural reaction creates an intermetallic bond between the laminates 102 which securely couples the laminates together, has no adverse electrical effects on electrical properties of the laminates, and provides a substantially uniform coefficient of thermal expansion throughout the structure 100. Thermal stresses and associated issues of laminated metal structures produced by other processes during the manufacture, installation and use of the structure are avoided.

It is understood, however, that other metallic bonding agents may be appropriately selected to achieve approximately matched thermal coefficients of expansion throughout the structure 100. For example, bismuth, zinc, tin, lead, cadmium, indium, antimony, silicon, tellerium, titanium, palladium, magnesium, aluminum, nickel, iron, cobalt, gold, silver, or any of their alloys may be used as the metallic bonding agents depending upon the metallic properties and characteristics of the laminates 102 in the stack 103.

The bonding agent 130 may be applied to the laminates 102, for example, according to a known electroplating, electroless plating, vapor deposition, or other methods and techniques familiar to those in the art. In one embodiment, the layer of bonding agent 130 is applied to a thickness of approximately one micron, although it is contemplated that in alternative embodiments up to about 25 microns may be employed in the illustrative embodiment. Thickness values of less than one micron may likewise be used in alternative embodiments, and it is contemplated that thickness values of, for example, 25 microns or less may be employed in other embodiments. A particular thickness of the bonding agent 130 for a given structure 100 is primarily dependent upon the thickness, internal geometric features and material properties of the laminates 102.

The laminates 102 and the bonding agent 130 may be reacted with one another under comparatively low temperature conditions, and the reaction is generally not pressure sensitive. Additionally, vacuum conditions are not required to react the bonding agent 130 with the metal laminates 102. Thus, in comparison to other manufacturing methods, the intermetallic bonding process is not equipment intensive and is therefore less costly than, for example, diffusion bonding techniques.

Figure 4:
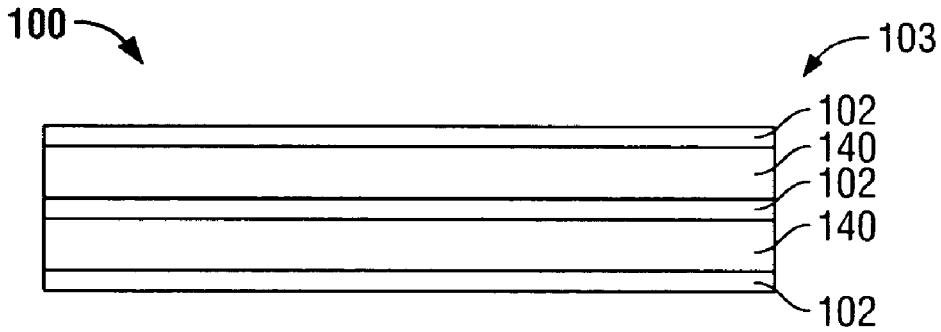
FIG. 4 is a partial cross sectional schematic view of the structure shown in FIG. 2.

FIG. 4 is a partial cross sectional schematic view of the structure 100 after the natural reaction between the bonding agent 130 and the laminates 102 is complete. To react the bonding agent 130 with the laminates 102, the stack 103 is heated to a sufficient temperature to promote the natural reaction of the bonding agent 130 with the laminates 102, and the temperature of the stack 103 is maintained at such temperature for a sufficient time to completely react the bonding agent 130 with the laminates 102.

When fully reacted, and as shown in FIG. 4, non-homogenous intermetallic zones 140 of a metallic bonding agent/base metal laminate material are created in the stack 103. Thus, for example, when copper laminates 102 are employed with a tin bonding agent 130, the zones 140 are a composite copper/tin composition (e.g., $Cu_6Sn_5$). As another example, if iron laminates 102 are employed with a tin bonding agent 130 the zones 140 comprise a composite iron/tin composition (e.g., $FeSn_2$). By implication, and as illustrated in FIG. 4, full reaction of the bonding agent 130 with the laminates 102 leaves no continuous layer of pure bonding agent material in the stack 103.

By way of example, for a laminate thickness of 200 microns and a bonding agent thickness of 1 micron, the bonding agent 130 may be completely reacted with the laminates 102 if heated for approximately five minutes at a temperature of 260° C. It is important that the bonding agent (e.g., tin) is completely reacted or exhausted by the natural reaction with the laminates 102, because any continuous layer of residual tin will adversely affect the stability of the bond between the laminates 102. It may be determined from known inspection methods, such as for example, x-ray diffraction techniques, whether the natural reaction is completely exhausted or whether residual bonding agent material remains for a given time and temperature profile in the intermetallic bonding process, and such techniques may be employed to determine an optimal time and/or temperature profile to react a selected laminate material with a selected bonding agent for a given thickness of bonding agent and laminates. Once the time and temperature profile is determined, the structures 100 may be manufactured in an efficient manner, both in terms of cost and time, while meeting desired specifications.

Figure 5:
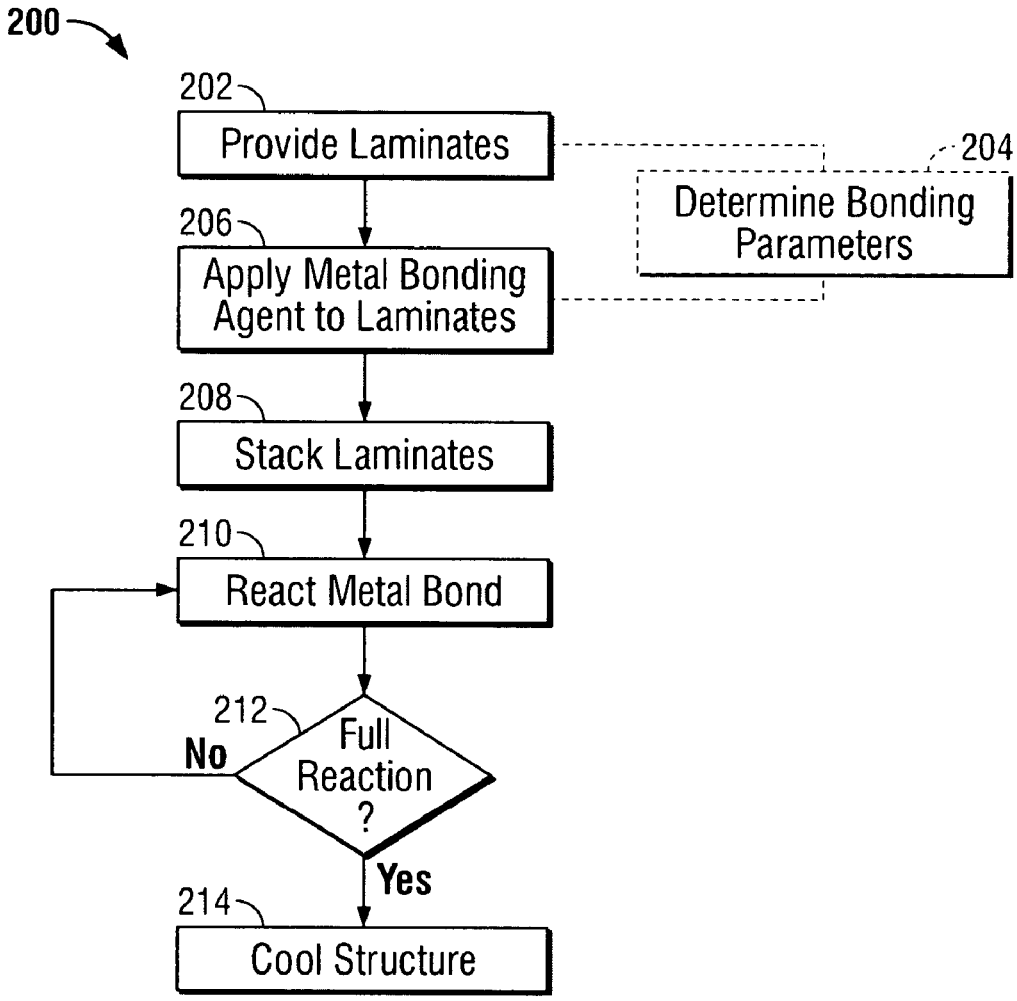
FIG. 5 is a process flowchart of a method to manufacture the structure shown in FIG. 5.

FIG. 5 is an exemplary process flowchart of a method 200 to manufacture the structure 100 as shown and described above. The laminates are formed as described above and provided 202 for assembly of the structure.

The bonding agent is then applied 206 to the laminates with the bonding agent extending between adjacent laminates, such as through a known plating process as described above. Once the bonding agent is applied 206, the laminates are stacked 208 in an aligned fashion in preparation for the intermetallic bonding reaction between the bonding agent and the laminates.

Once the laminates are stacked 208, the bonding agent is reacted 210 with the laminates by heating the stacked laminates to a predetermined reaction temperature, and maintaining the laminates at the reaction temperature for a predetermined period to fully and completely react the bonding agent with the laminates. It is understood that, for certain material selections of the laminates 102 and the bonding agent 130, the reaction may occur at room temperature, albeit more slowly than at a higher temperature. Thus, as used herein, heating the laminates to a predetermined reaction temperature may entail "heating" only to room temperature conditions.

If the bonding agent is not completely reacted, the reaction process continues 210. If the bonding agent is completely reacted, the process ends by cooling 214 the stack of laminates. The laminates in the stack are therefore coupled via the intermetallic bond as described above.

The above described intermetallic bonding agent is advantageous in a number of respects. The intermetallic bond is not equipment intensive and may be executed at low temperature.

Further, the coefficients of thermal expansion of the laminates and bonding agents may be matched with the coefficients of thermal expansion of the circuit board 116 and/or materials used in fabrication of a processor. Thus, for example, in a surface mount electrical connector application, the structure 100 will undergo a thermal expansion at approximately the same rate as the circuit board during solder reflow operations or actual product use environments. Thermal stress which would otherwise adversely affect the soldered connections of the contacts within the structure is eliminated, and the reliability of the soldered connection is ensured.

A three dimensional, metallic structure 100 is therefore provided which may capably serve as a metal housing for an electrical connector, despite its thin wall structure and while meeting stringent flatness and coplanarity requirements. Electrical shielding and ground plane advantages for the connector may therefore be provided in an economical housing offering superior performance advantages in comparison to conventional housings.

While the invention has been described in terms of various specific embodiments, those skilled in the art will recognize that the invention can be practiced with modification within the spirit and scope of the claims.

What is claimed is:

1. A conductive structure comprising a plurality of stacked metal laminates secured to one another via a conductive bonding agent of metal material, the bonding agent of metal material forming an intermetaltic bond between the stacked metal laminates, the bond being formed without diffusing bonding of the stacked laminates, wherein said plurality of laminates are of a first metal, said bonding agent is of a second metal different from said first metal, and said intermetallic bond is represented by a third metal that is a combination of said first metal and said second metal.

2. A conductive structure in accordance with claim 1 wherein said laminates define a metal housing of an electrical connector.

3. A conductive structure in accordance with claim 1 wherein said laminates comprise an outer periphery and an array of apertures within said outer periphery.

4. A conductive structure in accordance with claim 1 wherein said laminates are fabricated from copper, aluminum, tin, iron, nickel, cobalt, titanium, zinc, or alloys of copper, aluminum, tin, iron, nickel, cobalt, titanium and zinc.

5. A conductive structure in accordance with claim 1 wherein said intermetallic bond is formed from a metallic bonding agent having a thickness of about 25 microns or less.

6. A conductive structure in accordance with claim 1 wherein said intermetallic bond is formed from tin completely reacted with said laminates at a predetermined temperature for a predetermined time.

7. A conductive structure in accordance with claim 1 wherein said bonding agent is selected from the group of from bismuth, zinc, tin, lead, cadmium, indium, antimony, silicon, tellerium, titanium, palladium, magnesium, aluminum, nickel, iron, cobalt, gold, silver, or any of their alloys.

8. A conductive structure in accordance with claim 1 wherein said intermetallic bond comprises an intermetallic zone between adjacent laminates, said zone consisting of a nonhomogenous mixture of laminate material and bonding agent material.

9. A conductive structure in accordance with claim 1 wherein said plurality of laminates are monolithically formed via the intermetallic bond between the conductive bonding agent and the stacked metal laminates.

10. A housing for an electrical connector including a plurality of electrical contacts, said housing comprising:

a plurality of conductive laminates, each of said plurality of laminates defining a plurality of apertures;

wherein said laminates are substantially aligned with one another in a stacked arrangement, and said plurality of laminates are monolithically formed into a conductive structure via an intermetallic bonding process with a bonding agent of metal material that is reacted with said laminates to secure the laminates to one another without diffusion bonding techniques, said apertures of said laminates defining cavities to receive the electrical contacts, and wherein said plurality of laminates are of a first metal, said bonding agent is of a second metal different from said first metal, and said intermetallic bond is represented by a third metal that is a combination of said first metal and said second metal.

11. A housing for an electrical connector in accordance with claim 10 wherein said apertures comprise an array of apertures.

12. A housing for an electrical connector in accordance with claim 10 wherein said outer periphery of said laminates comprises at least one alignment feature.

13. A housing for an electrical connector in accordance with claim 10 wherein said laminates are fabricated from copper, aluminum, tin, iron, nickel, cobalt, titanium or zinc.

14. A housing for an electrical connector in accordance with claim 10 wherein said laminates are fabricated from alloys of copper, aluminum, tin, iron, nickel, cobalt, titanium or zinc.

15. A housing for an electrical connector in accordance with claim 10 wherein said laminates are plated with said metallic bonding agent of a material different from said laminates, said plating having a thickness of about 25 microns or less prior to intermetallic bonding of the laminates.

16. A housing for an electrical connector in accordance with claim 10 wherein said monolithic form comprises intermetallic zones consisting of a nonhomogenous mixture of laminate material and bonding agent material, said intermetallic zones extending between layers of pure laminate materials.

17. A housing for an electrical connector in accordance with claim 10 wherein said monolithic form comprises tin completely reacted with said laminates at a predetermined temperature for a predetermined time.

18. A housing for an electrical connector in accordance with claim 10 wherein said bonding agent is selected from the group of bismuth, zinc, tin, lead, cadmium, indium; antimony, silicon, tellerium, titanium, palladium, magnesium, aluminum, nickel, iron, cobalt, gold, silver, or any of their alloys.

* * * * *